US011033057B2

(12) United States Patent
Alvarez

(10) Patent No.: US 11,033,057 B2
(45) Date of Patent: Jun. 15, 2021

(54) CONVERTIBLE BIKINI TOP AND APPARATUS FOR CONVERSION OF A BIKINI TOP

(71) Applicant: Maria Eloisa Alvarez, Houston, TX (US)

(72) Inventor: Maria Eloisa Alvarez, Houston, TX (US)

( * ) Notice: Subject to any disclaimer, the term of this patent is extended or adjusted under 35 U.S.C. 154(b) by 198 days.

(21) Appl. No.: 16/275,594

(22) Filed: Feb. 14, 2019

(65) Prior Publication Data

US 2019/0200688 A1 Jul. 4, 2019

Related U.S. Application Data

(62) Division of application No. 15/335,772, filed on Oct. 27, 2016, now Pat. No. 10,244,805.

(51) Int. Cl.

| | |
|---|---|
| ***A41D 7/00*** | (2006.01) |
| ***A41F 15/00*** | (2006.01) |
| ***A41F 1/00*** | (2006.01) |

(52) U.S. Cl.

CPC ..... *A41D 7/00* (2013.01); *A41F 1/006* (2013.01); *A41F 15/002* (2013.01)

(58) Field of Classification Search

CPC ..... A41F 1/006; A41F 15/002; A41D 7/00; A41D 27/08; A41D 2300/33; A44C 25/00; Y10T 24/39; Y10T 24/3902; Y10T 24/3904; Y10T 24/3907; Y10T 24/3909; Y10T 24/3911; Y10T 24/3913; Y10T 24/3918; Y10T 24/3916; Y10T 24/3929

See application file for complete search history.

(56) References Cited

U.S. PATENT DOCUMENTS

| | | | | |
|---|---|---|---|---|
| 2,832,116 A * | 4/1958 | Clevett, Jr. | B65D 63/14 | 24/30.5 R |
| 3,043,902 A * | 7/1962 | Klein | H02G 7/12 | 174/146 |
| 3,827,790 A * | 8/1974 | Wenzel | G02C 3/003 | 351/123 |
| 4,288,891 A * | 9/1981 | Boden | F16G 11/101 | 24/115 G |
| 4,302,124 A * | 11/1981 | Wilks | F16G 11/02 | 403/391 |
| 4,771,516 A * | 9/1988 | Foth | F16G 11/105 | 24/115 R |
| 5,195,218 A * | 3/1993 | Joseph | F16G 11/00 | 24/129 D |
| 5,323,514 A * | 6/1994 | Masuda | F16G 11/101 | 24/115 G |

(Continued)

*Primary Examiner* — Khaled Annis

(74) *Attorney, Agent, or Firm* — Egbert, McDaniel & Swartz, PLLC

(57) ABSTRACT

A bead for use with a string bikini has a body with a front face in a rear face, a first passageway extending through the body and a second passageway extending through the body. These first and second passageways intersect and the bead is collapsible so as to move the front face toward the rear face. The passageways are adapted for receiving the strings of a string bikini so as secure the strings in the position relative to each other. The bead allows for tying a string bikini in a number of unconventional ways. The present invention also provides a string bikini with such a bead, and method for using a securing a string bikini.

16 Claims, 11 Drawing Sheets

(56) References Cited

U.S. PATENT DOCUMENTS 5,345,657 A * 9/1994 Shimizu ..... F16G 11/101 24/115 G
5,365,641 A * 11/1994 Watanabe ..... A45C 13/1046 24/115 G
5,440,788 A * 8/1995 Boden ..... F16G 11/14 24/115 H
5,611,118 A * 3/1997 Bibbee ..... A42B 7/00 2/195.1
5,657,513 A * 8/1997 Takahashi ..... F16G 11/101 24/115 G
5,666,699 A * 9/1997 Takahashi ..... F16G 11/101 24/115 G
6,189,186 B1 * 2/2001 Boden ..... F16G 11/14 24/115 H
7,140,078 B2 * 11/2006 Watabe ..... F16G 11/101 24/115 G
7,337,503 B1 * 3/2008 Ashbrook ..... E06B 9/327 24/115 G
8,181,320 B2 * 5/2012 Wolfberg ..... A43C 7/08 24/115 G
8,904,605 B2 * 12/2014 Kawaguchi ..... F16G 11/101 24/115 G
9,631,698 B2 * 4/2017 Gupta ..... F16G 11/02
2004/0181857 A1 * 9/2004 Brinks ..... A23G 3/563 2/424
2005/0091801 A1 * 5/2005 Feschuk ..... F16G 11/14 24/115 R
2005/0277362 A1 * 12/2005 Allen ..... A41C 3/0028 450/1
2014/0196188 A1 * 7/2014 Brady ..... A41D 15/00 2/67
2015/0007374 A1 * 1/2015 Larson ..... A41D 7/00 2/67
2015/0079876 A1 * 3/2015 Betts ..... A41C 3/0057 450/78
2016/0143372 A1 * 5/2016 Anderson ..... A41D 7/00 450/31

* cited by examiner

CONVERTIBLE BIKINI TOP AND APPARATUS FOR CONVERSION OF A BIKINI TOP

RELATED U.S. APPLICATIONS

The present application is a division of U.S. application Ser. No. 15/335,772, filed on Oct. 27, 2016, presently pending.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of women's swimwear. More particularly, the present invention relates to the field of women's bikini swimwear. Even more particularly, the present invention relates to a convertible string bikini top and an apparatus for conversion of a string bikini top.

2. Description of Related Art Including Information Disclosed Under 37 CFR 1.97 and 37 CFR 1.98

Women swimwear comes in a variety of types, including one-piece and two-piece swimsuits. Within these two types, there are many subtypes. An example of a type of two-piece women's swimwear is the string bikini.

An example of a prior art women's string bikini is shown in FIG. 1. Referring to FIG. 1, a conventional string bikini top 10 is shown. Such string bikini tops 10 can be provided in limitless number of colors and patterns, and can be often be relatively inexpensive. The string bikini top 10 includes a panel comprising a first panel 12 and a second panel 14. The first panel 12 is connected to the second panel 14, and collectively serve to cover the chest of the wearer.

Connected to the first panel 12 is a first string 16. The first string 16 is connected to a top portion of the first panel 12 and extends outwardly therefrom. Similarly, a second string 18 is affixed to the second panel 14. The second string 18 is affixed to the top of the second panel 14 and extends outwardly therefrom. Also connected to the first panel 12 is the third string 20. The third string 20 is connected to the bottom left corner of the first panel 12 and extends outwardly therefrom. Similarly, a fourth string 22 is shown is connected to the bottom right corner of the second panel 14 and extends outwardly therefrom.

In many bikinis, the third string 20 and fourth string 22 are actually one single string running through the structure of the bikini top 10, the single string also including the portion 13 shown between the first panel 12 and second panel 14. For the sake of clarity in the explanation of the structure, the portions of the string are referred to separately.

Referring to FIG. 2, it is shown how the conventional string bikini top 10 is worn by the wearer. FIG. 2 shows that two knots are made when wearing the string bikini top 10 of the prior art. The first knot 24 is tied behind the neck of the wearer. The first knot 24 is formed when the first string 16 is tied to the second string 18. The first knot 24 rests on the back of the wearer's neck.

The second knot 26 is positioned near the center of the back of the wearer. The second knot 26 is formed when the third string 20 is tied to the fourth string 22. The bikini bottom 11 is also shown in FIG. 2. The conventional string bikini top 10 can become uncomfortable after a period of a wear. Particularly, the first knot 24 at the back of the wearer's neck can cause discomfort to the wearer.

Various solutions to the problem of neck discomfort, as well as other problems and disadvantages associated with prior art swimmer, have been proposed in patents and patent applications in the past. For example, U.S. Patent Publication No. 2013/0059498, published on Mar. 7, 2013 in the name of Hersh, describes a convertible piece of swimwear. The swimwear of the Hersh publication includes a top piece with an extendable bottom piece. An intermediate section is provided on the swimwear which can be moved toward the bottom piece of the swimwear to effectively convert the one-piece style bathing suit to a two-piece style bathing suit.

U.S. Patent Publication No. 2011/0289646, published on Dec. 1, 2001 in the name of Scozzafava, describes an article swimwear with interchangeable components. The patent publication describes how the various components of the swimwear are connected via a series of integrated loops disposed on various pieces of the swimwear. FIGS. 3A, 3B, 4A and 4B illustrate how the various components of the swimwear are interconnected. For example, the vertical piece shown on the mid-section of the wearer in FIG. 1 can be replaced or removed by changing out the component labeled with reference numeral 32.

U.S. Pat. No. 6,009,556, issued on Jan. 4, 2002 to Nenninger, similarly discloses a swimwear item which can be altered in appearance by the wearer.

U.S. Patent Publication No. 2004/0134229, published on Jul. 15, 2004 in the name of Oliver, discloses various articles fabricated from strings of beads. FIG. 8A of the Oliver publication shows how a bikini top can be formed by a series of interconnected beads.

Various patents and patent application publications in the prior art relate to accessories for swimwear. For example U.S. Pat. No. 6,240,560, issued on Jun. 5, 2000 to DeCaro, describes a swimsuit provided with accessories. The DeCaro patent describes how various loop members and hook-and-loop fasteners are used to interchangeably attach a plurality of items, including straps, linked chains and other accessories in a manner which alters the style and appearance of the swimwear. The various accessories and straps also provide support to the wearer's breasts. Various other attachments are provided in the DeCaro patent, including attachments which would serve to convert the traditional two-piece swimsuit into one having a skirt or sash or other item of clothing thereon.

U.S. Patent Publication No. 2014/0053309, published on Feb. 27, 2014 in the name of Medina, discloses an ornamental connector for swimwear, and particularly for the bottom of a bikini. The ornamental body of the Medina publication includes a plurality of loops which are positioned on the connector so as to connect the connector to the front and back portions of the bikini bottom. The purpose of the connector is to provide ornamentation to the bikini bottom and also to produce styled tan lines in shape of the ornamental body of the flexible connector.

Various patents have also issued in the past relating to conventional string bikinis. For example, U.S. Pat. No. 8,631,515, issued on Jan. 21, 2014 to Van Sisseran et al., discloses a bikini top with a friction locking string adjustment mechanism. The swim top has a pair of friction locking adjustment terminal ends. Each friction locking adjustment terminal end is secured to an end of one of a pair of neck strings of the swim top. The friction locking adjustment terminal ends are slidably affixed to the opposing neck string of the swim top to permit the fit of the top to be adjusted. The friction locking adjustment terminal ends have adjustment buckles or slidable knots. Adjustment buckles include two or more silicone coated pads having holes for threading the strings of the swim top. A friction enhancing pattern may be proximate to the holes of the adjustment buckles. The friction enhancing pattern engages the string passing through that hole when the swim top is worn to enhance the secure fit of the swim top.

U.S. Pat. No. 7,168,096, issued on Jan. 30, 2007, to Landa et al., describes a bikini assembly. The bikini assembly includes a bikini top having a first panel and a second panel. A first strap and a second strap are each elongated and each has a first end and a second end. The first strap extends through the first panel. The second strap extends through the second panel. The first and second straps are looped together such that the first panel is attached to the second panel. The first and second straps form arm openings. A bikini bottom includes a third panel having a front edge, a back edge, a first side edge and a second side edge. A third strap is elongated and has a first end and a second end. The third strap extends into the front and back edges so that leg openings are formed between the third strap and each of the first and second side edges.

Finally, U.S. Patent Publication No. 2009/0235424, published on Sep. 24, 2009 to Carey, describes a bathing suit the top accessory. The top accessory is intended to relieve the discomfort associated with the conventional string bikini by moving the strings or strings and associated knots relative to the back of the wearer. The accessory has a four-cornered body. The body has an upper, lower, left, right, bottom and top side. The upper and lower sides of the body are substantially parallel and are from about two inches to about five and a half inches apart. The left and right sides of the body are from about one inch to about two and a half inches apart. The accessory further has four appendages. Each appendage has a first and a second end. The first end of each appendage attaches to each corner of the body. The appendages flow outward from the body at an angle that might range from about thirty-five degree to about fifty-five degree from either the upper or lower side of the body. Each appendage defines an eyelet adjacent to the second end of each appendage.

It is an object of the present invention to provide a bikini top which is convertible from a string bikini with to one having a crossed back shape and/or a straight shoulder shape.

It is another object the present invention to provide a bead for use with a conventional string bikini top to convert the bikini top to a crossed back shape or straight shoulder shape.

It is another object of the present invention to provide a string bikini top and bead for use with a string bikini top which relieves discomfort associated with the conventional neck and torso tied bikini top.

It is yet another object of the present invention to provide a string bikini and bead for conversion of the string bikini which provides alternate methods of tying the string bikini top.

It is another object the present invention to provide a string bikini top and bead for conversion of a string bikini top which accessorizes the bikini top using different colors, materials and shapes.

It is yet another object of the present invention to provide a string bikini top and bead for conversion of a string bikini top which are relatively simple and inexpensive to manufacture.

It is yet another object of the present invention to provide a kit for use with a conventional string bikini so as to convert the string bikini to other types of wearing styles.

These and other objects and advantages of the present invention will become apparent from a reading of the attached specification and appended claims.

BRIEF SUMMARY OF THE INVENTION

The present invention is a bead for use with a conventional string bikini top, the bead being utilized to enable tying of the string bikini top in a number of ways.

An embodiment of the present invention is a bead for use with a string bikini. The bead preferably includes a body having a front face and a rear face, a first passageway extending through the body, and a second passageway extending through the body, the second passageway intersecting with the first passageway, the body being collapsible so as move said front face toward said rear face. The first passageway and second passageway are adapted to respectively receive strings of the string bikini therein. Preferably, each of said front and rear faces have a thickness or arc length greater than a thickness or arc length of portions of the body extending between the front face and the rear face. The body is preferably biased so as to collapse such that said front face moves toward said rear face.

In an embodiment of the present invention, the body has inner walls suitable for frictionally engaging strings of the string bikini. The inner walls may have a plurality of ridges extending inwardly from the inner walls, the plurality of ridges being adapted to frictionally engage strings of the string bikini. Preferably, the bead is constructed of an elastomer-type material such as silicone.

In an embodiment, each of the first passageway and the second passageway include a first circular opening on one side of the body, and a second circular opening on an opposite side of the body.

The present invention is also a bikini having a panel, a first string extending outwardly from the panel, a second string extending outwardly from the panel, and a bead having first and second passageways extending therethrough, the first passageway intersecting the second passageway, the first string being threaded through the first passageway, the second string being threaded through the second passageway. The first string preferably frictionally engages the second string at an intersection of the first passageway and second passageway. The first string and second string also preferably frictionally engage an inner surface of the bead. A knot may be tied in one or more of the strings so as to prevent the string from passing back through the bead.

In an embodiment of the bikini of the present invention, the bead has a front face and a rear face, each of which have an inner wall thickness and arc length greater than an inner wall thickness and arc length of portions of the bead extending between the front face and rear face. Preferably, the bead is biased so as to collapse such that the front face moves to the said rear face. The inner surface of the bead may have a plurality of ridges extending inwardly towards the passageways, the plurality of ridges being adapted to frictionally engage the first string and the second string. Preferably, the bead is formed of a silicone material.

In an embodiment of the bikini of the present invention, the bikini has another bead having first and second passageways extending therethrough, a third string extending outwardly from the panel, the third string being threaded through the first passageway of the another bead, and a fourth string extending outwardly from the panel, the fourth string being threaded through the second passageway of the another bead.

The present invention is also a method of securing a string bikini, the string bikini having a panel with first and second strings extending outwardly therefrom. The method preferably includes the steps of: providing a bead having intersecting first and second passageways extending therethrough; threading the first string through the first passageway of the bead; and threading the second string through the second passageway of the bead such that the first string frictionally engages the second string so as to hold the first string in a position relative to the second string. Preferably, the bead has a front face and a rear face, the bead being collapsible such that the front face is collapsed toward the rear face.

In an embodiment of the method of the present invention, the string bikini has third and fourth strings extending outwardly from the panel, and the method further includes the steps of: providing another bead having intersecting first and second passageways extending therethrough; threading the third string through the first passageway of the another bead; threading the fourth string through the second passageway of the another bead such that the third string frictionally engages the fourth string so as to hold the third string in a position relative to the fourth string; and adjusting the first string relative to the second string and the third string relative to the fourth string so as to secure the string bikini in place. The bead may have a plurality of internal ridges suitable for frictionally engaging the strings. The method may further include the step of tying knots in one of the first and second strings and one of the third and fourth strings so as to prevent the respective string from being pulled through the respective bead.

This foregoing Section is intended to describe, in particularity, the preferred embodiment of the present invention. It is understood that modifications to these preferred embodiments can be made within the scope of the present invention. As such, this Section should not to be construed, in any way, as limiting of the broad scope of the present invention. The present invention should only be limited by the following claims and their legal equivalents.

DETAILED DESCRIPTION OF THE INVENTION

Figure 1:
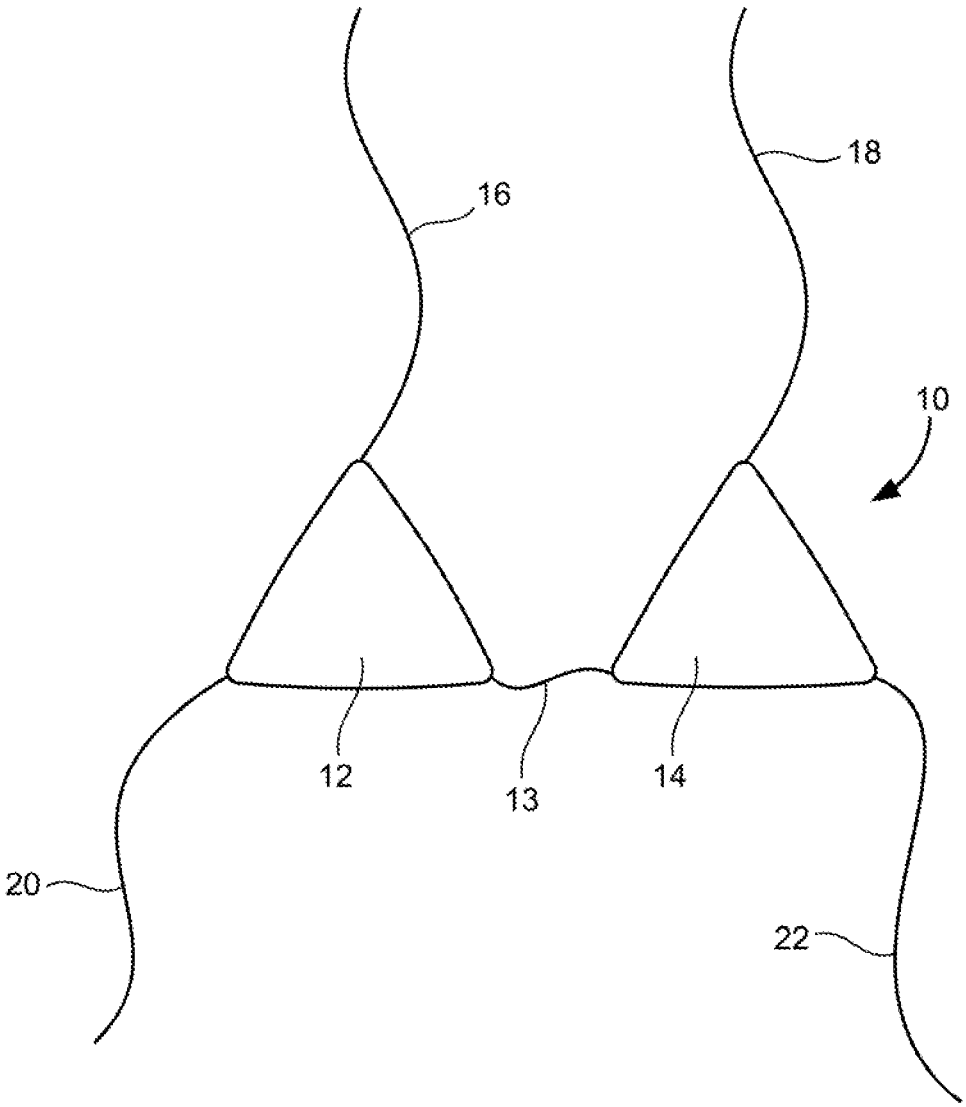
FIG. 1 PRIOR ART
FIG. 1 is a front view of the conventional string bikini top of the prior art.
Figure 2:
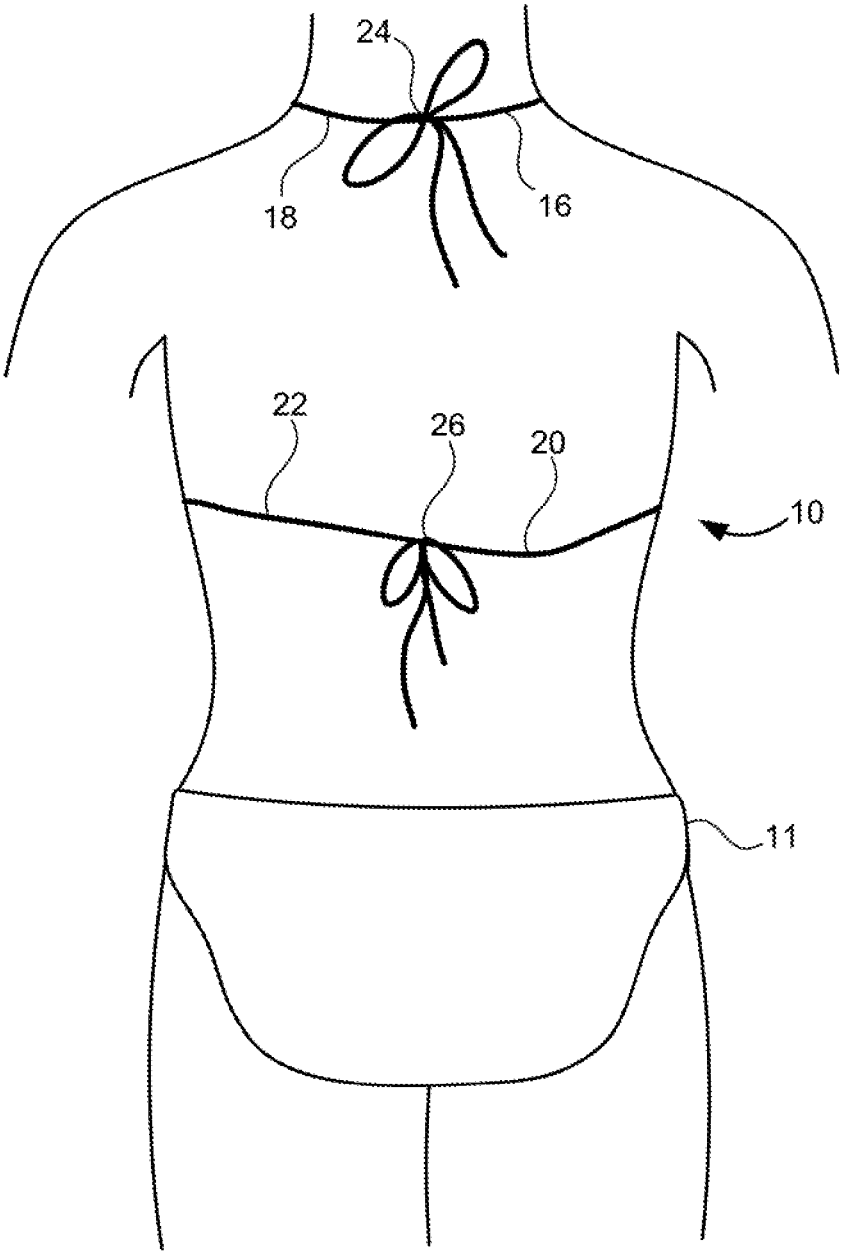
FIG. 2 PRIOR ART
FIG. 2 rear view of the prior art string bikini top as worn in a conventional manner.
Figure 3:
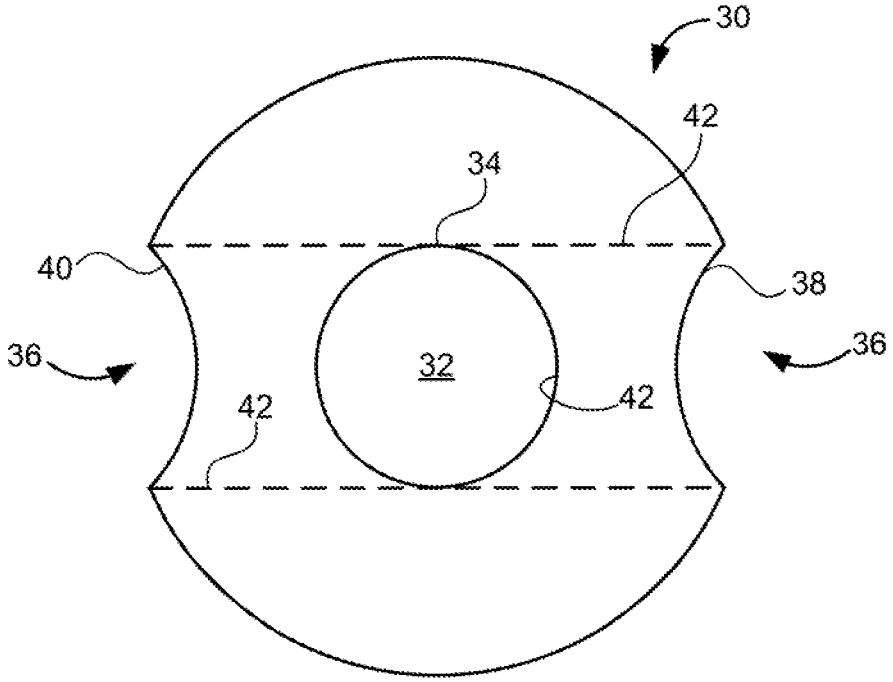
FIG. 3 is a front view showing the bead for conversion of a string bikini top in accordance with the preferred embodiment of the present invention.

Referring to FIG. 3, there shown the bead 30 of the present invention. The bead 30 is utilized to convert a conventional string bikini, as shown in FIGS. 1 and 2, to the bikini top having a variety of alternative tying methods. In FIG. 3, it can be seen how the bead 30 has a first passageway 32 formed therethrough. An opening 34 is also shown in FIG. 3. Though not shown in FIG. 3, there is an identical opening on the opposing side of the bead 30 where the first passageway 32 opens to the opposite side of the bead 30.

A second passageway 36 is shown as being perpendicular to the first passageway 32. The second passageway 36 has openings 38 and 40 on the outside of the bead 30. Preferably, the second passageway 36 intersects the first passageway 32 at the center of the beads 30. The second passageway 36 is shown in broken lines extending through the center of the bead 30. The passageways 32 and 36 could also be formed so as to not intersect.

Inner walls 42 are shown on the first passageway 32 and second passageway 36. As will be explained hereinbelow, the inner walls 42 of the passageways 32 and 36 serve to frictionally engage strings of the string bikini top so as to secure the strings relative to the beads 30.

Preferably, the bead 30 of the present invention is formed of an elastomer-type material such as silicone, and is formed in a round shape. However, various other shapes and materials are envisioned by the inventor so as to properly accessorize and match conventional string bikini tops. The various colors and shapes can be used to accessorize the purchaser's string bikini top.

Figure 4:
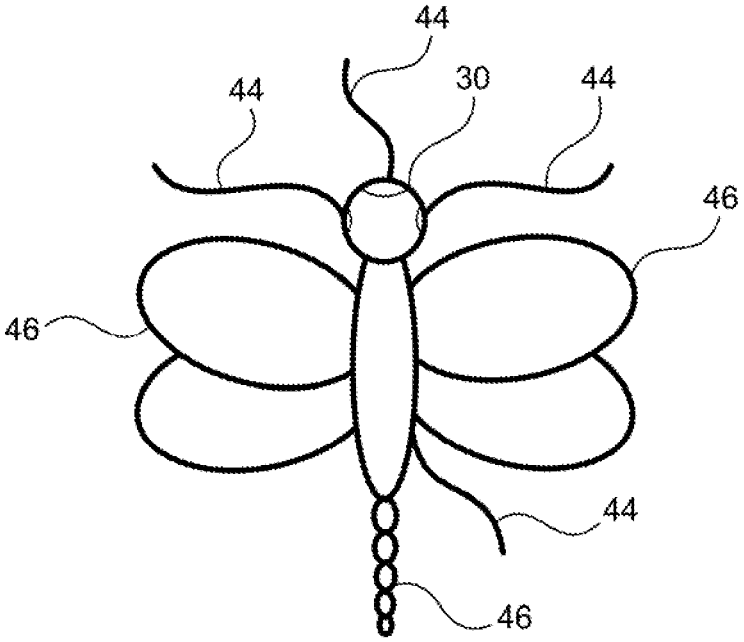
FIG. 4 shows the bead of the present invention with ornamentation thereon.

In FIG. 4, there shown how the bead 30 of the present invention can be used in an ornamental manner. In FIG. 4, the bead 30 is shown as being attached to ornamentation 46. The ornamentation 46 is in the shape of a dragonfly, as an example of a possible accessory. Various strings 44 are shown as extending through the interior and passageways 32 and 36 of the bead 30 of the present invention. Limitless shapes of ornamentation 46 can be provided for use with the bead 30.

Figure 5:
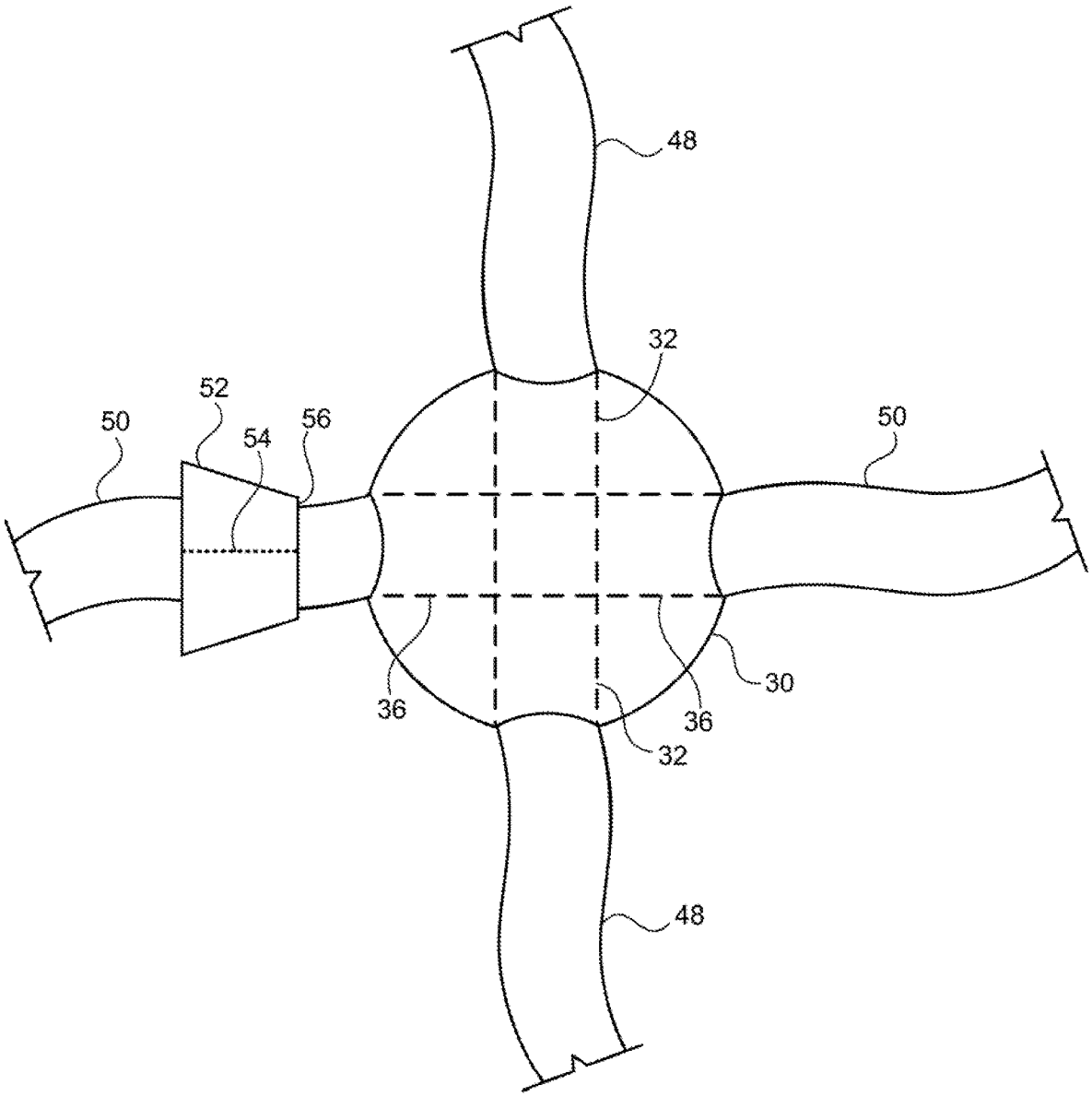
FIG. 5 shows an isolated view of the various strings of the bikini top of the present invention as threaded through the bead acstringing to the present invention.

Referring to FIG. 5, it is shown how the bead 30 of the present invention is used with the strings of the string bikini. In FIG. 5, a first string 48 is shown as extending into and through the first passageway 32 of the bead 30. Similarly, a second string 50 is shown as extending through the second passageway 36 of the bead 30. The strings 48 and 50 are frictionally engaged with both the interior walls of the bead 30, and also with the opposing string, so as to secure the string relative to the bead 30.

FIG. 5 also shows an embodiment of the present invention wherein a tapered stopper 52 is provided. The tapered stopper 52 can be clasped around the string 50, and may have a hinge 54. Preferably, the tapered stopper 52 has a small end 56 which abuts or is received by the adjacent opening in the bead 30. The larger end of the tapered stopper 52 is prevented from entering the interior of the bead 30. As such, as the tapered stopper 52 is clasped about the second string 50, the second string 50 is further prevented from sliding relative to the bead 30. The stopper 52 can be used in instances where the passageway of the bead 30 are significantly larger than the associated strings, and it can also be used in instances where additional securement is desired by the wearer. Similar tapered stoppers can be provided on any of the openings of the bead 30 of the present invention. As an alternative to the stopper, a knot could be tied in the string if needed or preferred.

Figure 6:
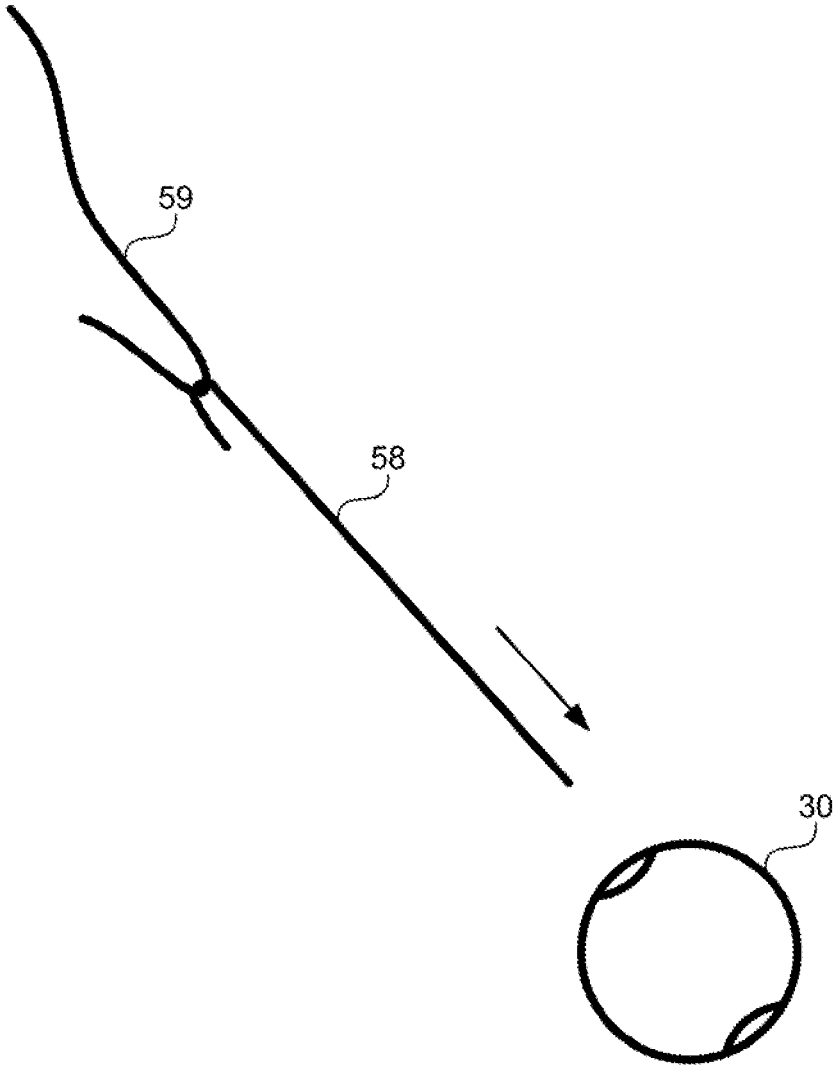
FIG. 6 shows an isolated view of a threading means used with the bead of the present invention.

Referring to FIG. 6, there is shown in isolated view of an alternative embodiment of the present invention, wherein a threading means 58 is provided. The threading means 58 shown in FIG. 6 is in the form of a needle having a hook for attachment to the string 59. Various other shapes and apparatuses could be used to accomplish threading of the strings. However, the threading means should be small enough to be inserted through the passageways of the bead 30 of the present invention so as to draw the string 59 through the interior of the bead 30. The threading means 58 is particularly useful when the inner walls of the bead 30 are relied upon solely for the frictional engagement with the strings, and also in a case where the stoppers is described in FIG. 5 are not used.

The present invention may also be a kit including the bead 30 as described hereinabove. Preferably, at least two of the beads 30 are provided in the kit of the present invention. Sets of beads in the kit of the present invention may have different shapes and colors for use with different bikini tops owned by the purchaser. The kit of the present invention may also include threading means 58 as described in FIG. 6, as well as one or more of the stoppers 52 as described in FIG. 5. The purchaser of the kit can then convert the conventional string bikini top or tops into bikini tops which can be worn in a variety of tieback styles, as will be described herein below.

Figure 7:
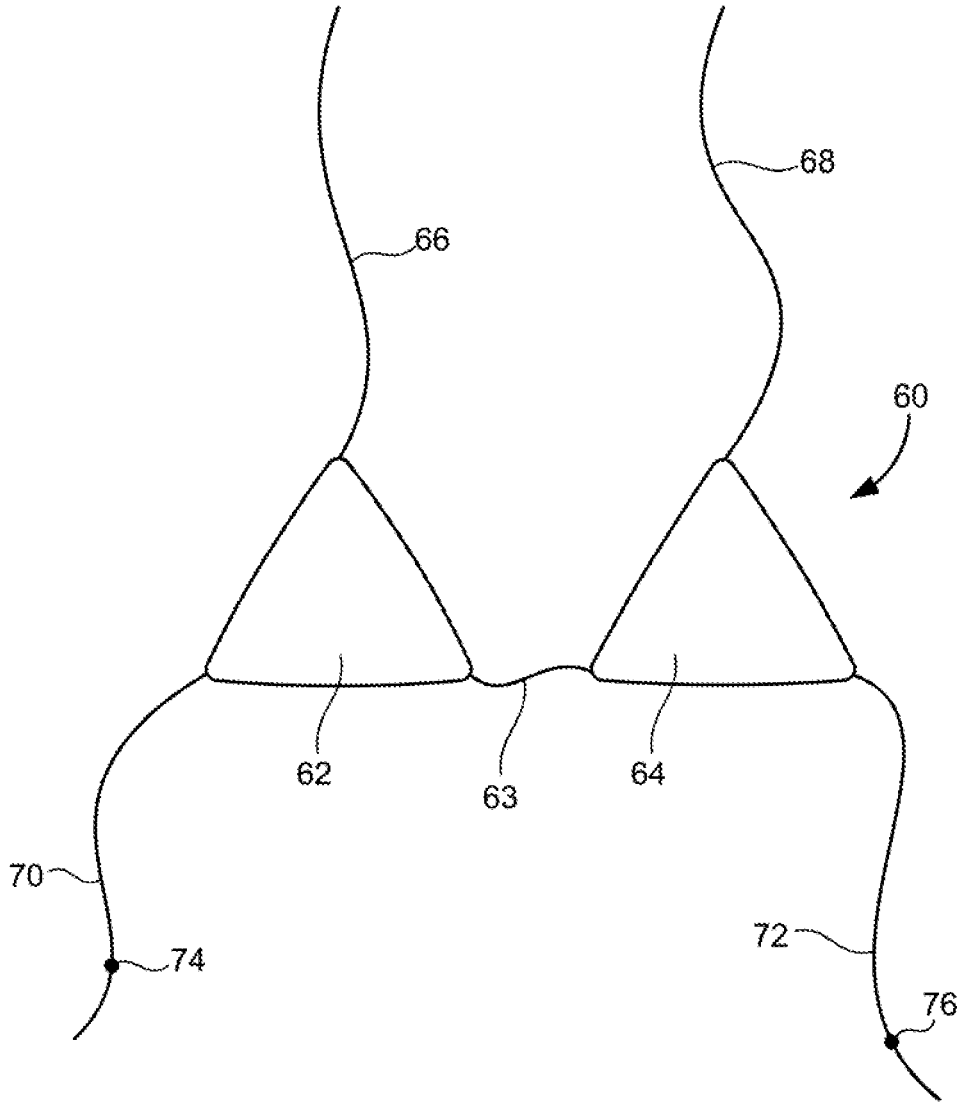
FIG. 7 shows a front view of the string bikini top and conversion bead of the present invention.

Referring to FIG. 7, there is shown the convertible string bikini top 60 in accordance with an embodiment of the present invention. FIGS. 7-10 are intended to show the use of the bead 30 of the present invention, as well as an embodiment of the present invention which includes both a string bikini top with beads 30 attached thereto.

The string bikini top 60 shown in FIG. 7 includes a first panel 62 and a second panel 64 (collectively "a panel"). The first panel 62 is connected to the second panel 64 and serves to cover the chest of the wearer. A first string 66 is connected to the top corner of the first panel 62, while a second string 68 is connected to the top corner of the second panel 64. A third string 70 is connected to the bottom left corner of the first panel 62, while a fourth string 72 is connected to the bottom right corner of the second panel 64. A first bead 74 is shown as slidably received on the third string 70, while a second bead 76 is shown as being slidably received on the fourth string 72. Alternatively, the first bead 74 can be slidably received by the first string 66 and the second bead 76 can be slidably received by the second string 68.

As noted with reference to FIG. 1, the third string 70 and fourth string 72 shown in FIG. 7 may actually be one single string running through the structure of the bikini top 60, the single string also including the portion 63 shown between the first panel 62 and second panel 64.

Figure 8:
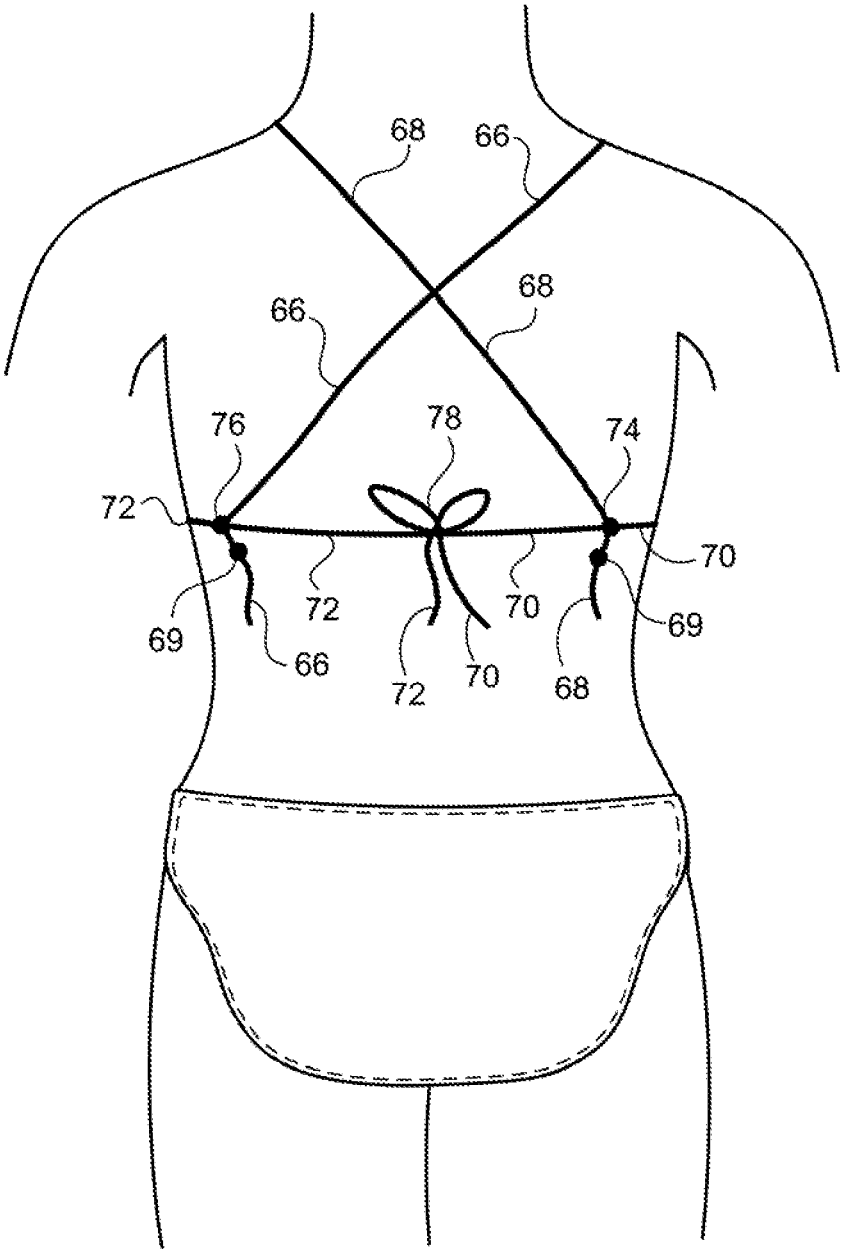
FIG. 8 shows a rear view of the string bikini top and conversion bead of the present invention worn in a crossed back configuration.

Referring to FIG. 8, there is shown the string bikini top 60 with convertible bead apparatuses as used to tie the string bikini top 60 in a crossed back configuration. In order to achieve this configuration, the first string 66 is threaded through one of the passageways of the second bead 76. Similarly, the second string 68 is threaded through one of the passageways of the first bead 74. This procedure serves to connect the first string 66 with the fourth string 72. Similarly, the second string 68 is connected to the third string 70.

At this point, the various strings are tightened so as to form the crossed back configuration. Specifically, the first string 66 is pulled through the second bead 76 and the second string 68 is pulled through the first bead 74. Once the strings are properly tightened, knots 69 may be tied in the strings 66 and 68 so as to prevent the strings from being pulled back through the beads. Then, the third string 70 is tied at knot 78 to fourth string 72. The ends of the first string 66 and second string 68 are shown as falling loosely below the second bead 76 and first bead 74, respectively. As such, the beads of the present invention have been used to convert a traditional string bikini top with a neck and torso tieback into a crossed back shaped tieback. As such, this eliminates the neck discomfort associated with the traditional knot behind the neck.

Figure 9:
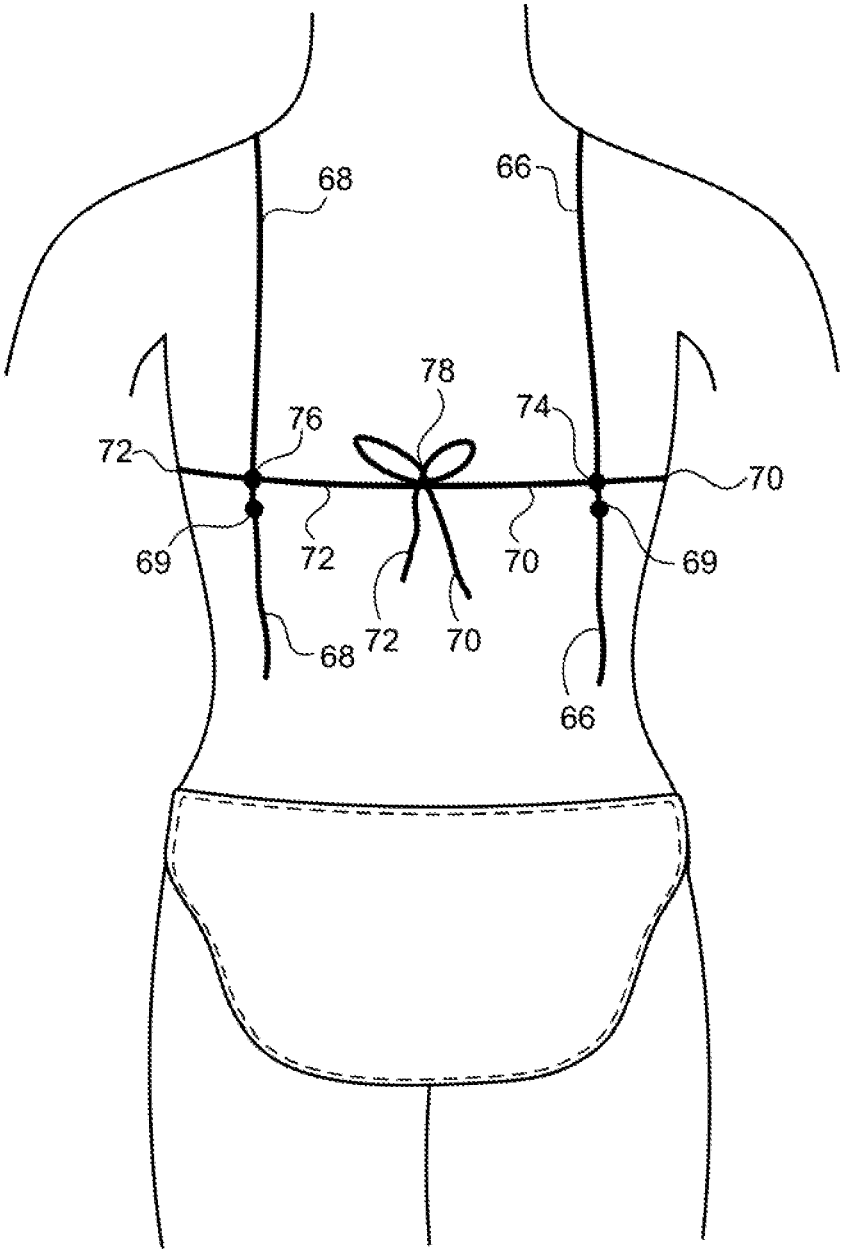
FIG. 9 shows a rear view of the string bikini top and conversion bead of the present invention as worn in a straight shoulder shape.

Referring to FIG. 9, there is shown how the beads of the present invention are used convert the string bikini top to a straight shoulder shape with a torso tieback. To convert the string bikini top to the straight shoulder shape with a torso tieback, the first string 66 is threaded through the first bead 74. Similarly the second string 68 is threaded through the second bead 76. These strings are then tightened by pulling them through the prospective beads. Once the strings are properly tightened, knots 69 may be tied in the strings 66 and 68 so as to prevent the strings from being pulled back through the beads. The ends of the first string 66 and 68 are shown as falling loosely below the beads 74 and 76, respectively. The third string 70 is then tied to the fourth string 72 to form a knot 78 at the center of the wearer's back. Thus, the traditional string bikini top has been converted to a straight shoulder shape with a torso tie back, thus eliminating the discomfort associated with the knot behind the wearer's neck.

Use of the string bikini top and/or the conversion bead of the present invention allows the string bikini top to be worn in a variety of ways. However, the use of the conversion bead does not prevent the wearer from wearing the string bikini top in the conventional torso and neck tie back way.

Figure 10:
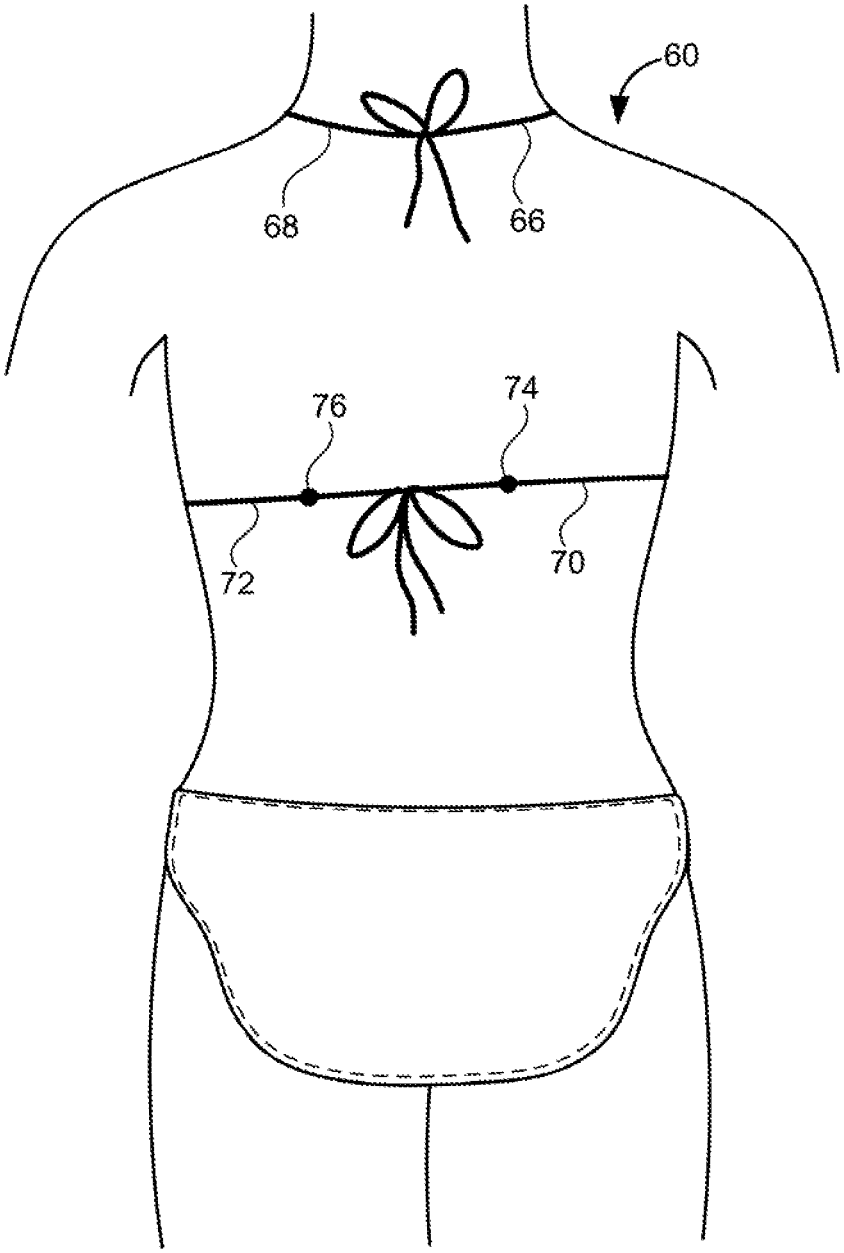
FIG. 10 shows a rear view of the bikini top and conversion bead of the present invention as worn in a conventional neck and torso tied configuration.

FIG. 10 shows the string bikini top 60 of the present invention with the beads 74 and 76 wherein the string bikini top is tied in the conventional neck and torso tie method. The first bead 74 and second bead 76 are positioned on the back of the wearer. Unlike the embodiments shown in FIG. 8 and FIG. 9, however, there is only a single string threaded through each of the first bead 74 and the second bead 76.

Figure 11:
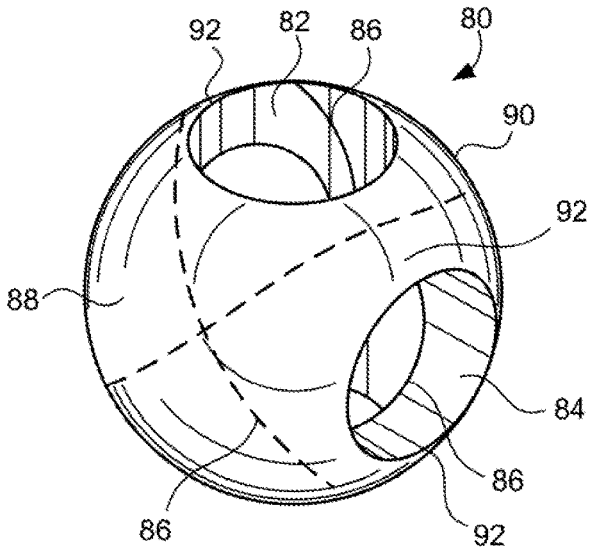
FIG. 11 shows a perspective view of a bead in accordance with the preferred embodiment of the present invention.

Referring to FIG. 11, there is shown a perspective view of the bead 80 of the preferred embodiment of the present invention. The beads described in previous figures are generally shown as a round bead having opposing holes running through the bead. The bead 80 in accordance with a preferred embodiment the present invention has a slightly more hollowed out interior section, as is described herein below, biased so as to comfortably collapse when pressed upon. FIG. 11 shows how the bead 80 has a first passageway 82 and a second passageway 84 formed there through. Preferably, the first and second passageways 82 and 84 intersect at an angle of approximately 90° within the interior of the bead 80.

FIG. 11 shows how the bead 80 of the preferred embodiment the present invention may have a plurality of internal ridges 86. The internal ridges 86 are illustrated in broken lines on the exterior of the bead and solid lines where visible from the exterior of the bead. These internal ridges 86 serve to enhance the frictional engagement between the bead 80 and the strings extending through the passageways of the bead 80.

FIG. 11 also shows how the bead 80 has a front face 88 and a rear face 90 opposite the front face 88. Connecting portions 92 are shown as extending between the front face 88 and the rear face 90. The connecting portions 92 preferably have an inner wall thickness and arc length less than the inner wall thickness and arc length of the front face 88 and the rear face 90. The bead 80 is easier to compress when pressing against the front and rear faces 88 and 90 due to the lesser thinner inner wall thickness and arc length of the connecting portions 92 as compared to the front and rear faces 88 and 90. This bias to collapse such that the front face 88 is moved toward the rear face 90 makes for a more comfortable experience for the wearer.

Figure 12:
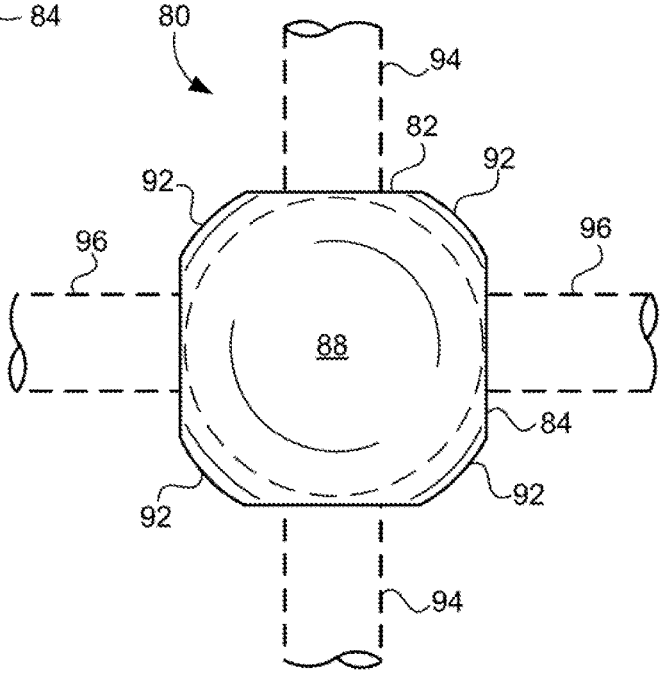
FIGS. 12 and 12A are front and side views of the bead of the preferred embodiment of the present invention.
Figure 12A:
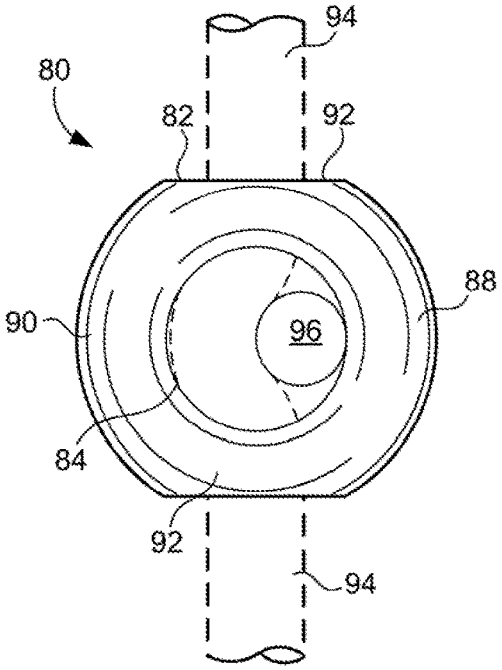

FIG. 12 shows a front view of the bead 80 in accordance with the preferred embodiment of the present invention and FIG. 12A shows a side view thereof. FIGS. 12 and 12A illustrate the bead in a non-collapsed state. In the event of the wearer of the bikini were to lay down, the front face 88 would press against the wearer's back, while the rear face 90 would press against the surface below the wearer. In this instance, the connecting portions 92 would collapse or fold over such that the front face 88 is moved toward the rear face 90.

Figure 13:
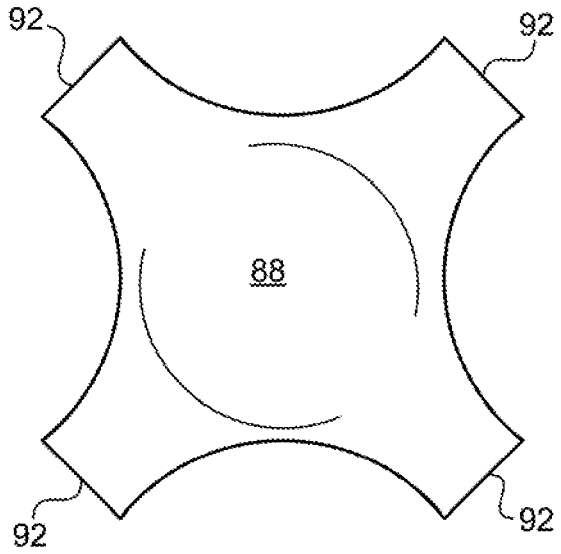
FIG. 13 is a front view of the bead of the preferred embodiment of the present invention in a collapsed state.

FIG. 13 shows the bead 80 in a collapsed state, wherein the connecting portions 92 are folded over and the front face 88 and rear face 90 moved toward each other.

Figure 14:
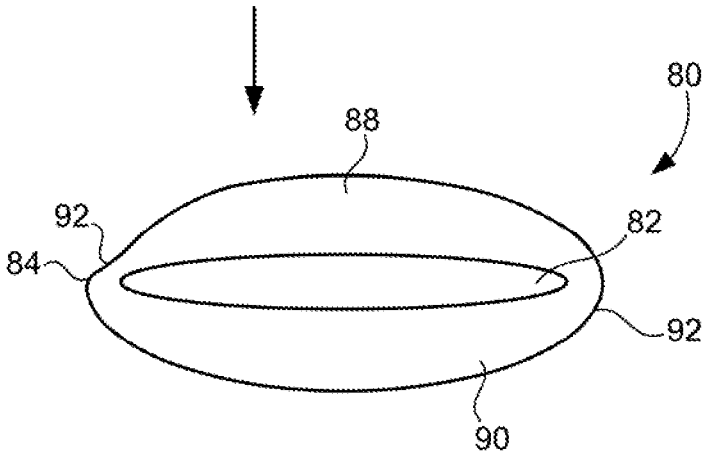
FIG. 14 is a side view of the bead of the preferred embodiment of the present invention in a collapsed state.

FIG. 14 shows a side view of the bead 80 in a collapsed state wherein the front face 88 nearly abuts the rear face 90, and the connecting portions 92 are collapsed or folded over. As can be seen in FIG. 14, the front face 88 and rear face 90 preferably have a gently sloping surface so as to be comfortable against the back of the wearer. As can be appreciated, this would be much more comfortable than lying down on a hard, non-collapsible bead. The collapsible aspect of the present invention is enabled by constructing the bead of a soft material, such as silicone or other elastomeric-type material. As compared to a simple cylindrical passageway, the internal ridges provided by the hollowed-out interior of the bead 80 of the preferred embodiment of the present invention provides substantially greater engagement frictionally with the strings extending through the passageways. The enhanced frictional engagement is important so that the wearer is confident in the ability of the bead to secure the bikini strings.

In the bikini in accordance with the preferred embodiment the present invention, the bikini would have two beads as shown in FIG. 11 so as to properly affix the four strings of the bikini. In accordance with a preferred embodiment present invention, there is provided a method of securing a string bikini wherein the string bikini has a panel with first and second strings extending outwardly therefrom. The method includes steps of: providing a bead having intersecting first and second passageways extending therethrough, threading the first bikini string through the first passageway of the bead and threading the second string through second passageway of the bead such that the first string frictionally engages the second string so as to hold the first string a position relative to the second string. Preferably, in the method the present invention, the bead has a front face and a rear face wherein the bead is collapsible such that the front face is collapsed toward the rear face.

In an embodiment of the method of the present invention, the string bikini has third and fourth strings extending outwardly from the panel and the method further comprises steps of: providing another bead having intersecting first and second passageways extending therethrough, threading the third string through the first passageway of the bead and threading the fourth string through the second passageway of the another bead such that the third string frictionally engages the fourth string so as to hold the third string in a position relative to the fourth string, and adjusting the first string relative to the second string and the third string relative to the four string so as to secure the string bikini in place. The method may further include the step of tying knots in one of the first and second strings and one of the third and fourth strings so as to prevent the respective string from being pulled through the bead.

The bead of the present invention allows for accessorizing and customization of the various string bikini tops owned by the purchaser. The conversion bead of the present invention provides a relatively inexpensive way to enhance the utility of the string bikini tops owned by the purchaser. The conversion bead of the present invention can be sold alongside or together with a conventional string bikini top. Different sized passageways through the beads can be provided for different sizes of strings.

The foregoing disclosure and description of the invention is illustrative and explanatory thereof. Various changes in the details of the illustrated construction or in the steps of the described method can be made within the scope of the appended claims without departing from the true spirit of the invention. The present invention should only be limited by the following claims and their legal equivalents.

I claim:

1. A bead for use with a string bikini, the bead comprising:
a body having a front face and a rear face;
a first passageway extending through said body; and
a second passageway extending through said body, said second passageway intersecting with said first passageway, said first passageway being perpendicular to said second passageway, said body being collapsible so as to move said front face toward said rear face.

2. The bead of claim 1, said first passageway and said second passageway adapted to respectively receive strings of the string bikini therein.

3. The bead of claim 1, wherein four connecting portions extend between said front face and said rear face, said connecting portions being defined by openings of the first and second passageways, said connecting portions being integrally formed with said front and rear face, each of said front face and said rear face having an inner wall thickness greater than an inner wall thickness of each of the connecting portions.

4. The bead of claim 1, said body being biased so as to collapse such that said front face moves toward said rear face.

5. The bead of claim 1, said body having inner walls adapted to frictionally engaging strings of the string bikini.

6. The bead of claim 5, said inner walls having a plurality of ridges extending inwardly from said inner walls, said plurality of ridges adapted to frictionally engage strings of the string bikini.

7. The bead of claim 1, bead being an elastomeric material.

8. The bead of claim 1, each of said first passageway and said second passageway comprising:

a first circular opening on one side of said body; and a second circular opening on an opposite side of said body.

9. A bikini comprising:

a panel;

a first string extending outwardly from said panel;

a second string extending outwardly from said panel; and a bead having first and second passageways extending therethrough, said first passageway intersecting said second passageway, said first passageway being perpendicular to said second passageway, said first string being threaded through said first passageway, said second string being threaded through said second passageway.

10. The bikini of claim 9, said first string frictionally engaging said second string at an intersection of said first passageway and said second passageway.

11. The bikini of claim 9, said first string and said second string frictionally engaging an inner surface of said bead.

12. The bikini of claim 9, said bead having a front face and a rear face, wherein four connecting portions extend between said front face and said rear face, said connecting portions being defined by openings of the first and second passageways, said connecting portions being integrally formed with said front and rear face, each of said front face and said rear face having an inner wall thickness greater than an inner wall thickness of the connecting portions.

13. The bikini of claim 9, said bead being biased so as to collapse such that said front face moves toward said rear face.

14. The bikini of claim 9, said inner surface of said bead comprising a plurality of ridges extending inwardly toward said first passageway and said second passageway, said plurality of ridges being adapted to frictionally engage said first string and said second string.

15. The bikini of claim 9, said bead being formed of an elastomeric material.

16. The bikini of claim 9, further comprising:

another bead having first and second passageways extending therethrough, said first passageway of said another bead being perpendicular to said second passageway of said another bead;

a third string extending outwardly from said panel, said third string being threaded through said first passageway of said another bead; and a fourth string extending outwardly from said panel, said fourth string being threaded through said second passageway of said another bead.

* * * * *